US006254031B1

(12) United States Patent
Mayersak

(10) Patent No.: US 6,254,031 B1
(45) Date of Patent: Jul. 3, 2001

(54) PRECISION GUIDANCE SYSTEM FOR AIRCRAFT LAUNCHED BOMBS

(75) Inventor: Joseph R. Mayersak, Ashburn, VA (US)

(73) Assignee: Lockhead Martin Corporation, Bethesda, MD (US)

( * ) Notice: Subject to any disclaimer, the term of this patent is extended or adjusted under 35 U.S.C. 154(b) by 0 days.

(21) Appl. No.: 09/154,767

(22) Filed: Aug. 27, 1998

Related U.S. Application Data

(63) Continuation-in-part of application No. 08/853,607, filed on May 9, 1997, now Pat. No. 5,893,103, which is a continuation-in-part of application No. 08/562,426, filed on Nov. 24, 1995, now Pat. No. 5,657,947, which is a continuation-in-part of application No. 08/295,108, filed on Aug. 24, 1994, now Pat. No. 5,507,452.

(51) Int. Cl.[7] ..... F42B 10/60
(52) U.S. Cl. ..... 244/3.22; 244/52; 102/384
(58) Field of Search ..... 244/3.22, 51, 52, 244/76 J, 78, 169; 102/374, 375, 381, 384

(56) References Cited

U.S. PATENT DOCUMENTS 2,495,304 * 1/1950 Wyckoff et al. ..... 102/384
2,974,594 * 3/1961 Boehm ..... 244/169
4,364,530 * 12/1982 Ripley-lotee et al. ..... 244/3.22
4,550,888 * 11/1985 Douglass et al. ..... 244/3.22
4,568,040 * 2/1986 Metz ..... 244/3.22
4,955,558 * 9/1990 Machell et al. ..... 244/3.22
4,979,697 * 12/1990 Kranz ..... 244/3.22
5,054,712 * 10/1991 Bar et al. ..... 244/3.22
5,070,761 * 12/1991 Fidler ..... 244/3.22
5,074,492 * 12/1991 Morgand ..... 244/3.22
5,076,511 * 12/1991 Stein et al. ..... 244/3.22
5,112,007 * 5/1992 Buchele-Buecher ..... 244/3.22
5,123,611 * 6/1992 Morgand ..... 244/3.22
5,129,604 * 7/1992 Bagley ..... 244/3.22
5,273,237 * 12/1993 Guyton et al. ..... 244/52
5,386,951 * 2/1995 Gaywood ..... 244/3.22
5,433,399 * 7/1995 Becker et al. ..... 244/3.22
5,456,429 * 10/1995 Mayersak ..... 244/76 J

* cited by examiner

*Primary Examiner*—Galen L. Barefoot
(74) *Attorney, Agent, or Firm*—Charles E. Temko

(57) ABSTRACT

The disclosure relates to a low cost and highly accurate precision guided system suitable for use in conventional aircraft launched bombs. The system includes a kit mounted upon the nose of the conventional bomb which replaces the conventional fuse disposed in a fuse well, the kit including guidance electronics controlling a self-contained jet reaction device and GPS P-code receiver electronics. The bombs are readied for discharge by signals broadcast from the aircraft into the bomb bay which transfer initial GPS data and commence operation of a gas generator which powers the jet reaction device.

5 Claims, 11 Drawing Sheets

VENTING DURATION TABLE
JET REACTION CONTROL FIRING SEQUENCE
TO
GENERATE SPECIFIC IMPULSE LEVELS

| FORCE LEVEL | FIRING SEQUENCE | FORCE LEVEL | FIRING SEQUENCE | FORCE LEVEL | FIRING SEQUENCE | FORCE LEVEL | FIRING SEQUENCE |
|---|---|---|---|---|---|---|---|
| 1t | 1t | 11t | 9t+3t-1t | 21t | 27t-9t+3t | 31t | 27t-3t+1t |
| 2t | 3t-1t | 12t | 9t+3t | 22t | 27t-9t+3t+1t | 32t | 27t+9t-3t-1t |
| 3t | 3t | 13t | 9t+3t+1t | 23t | 27t-3t-1t | 33t | 27t+9t-3t |
| 4t | 3t+1t | 14t | 27t-9t-3t-1t | 24t | 27t-3t-1t | 34t | 27t+9t-3t+1t |
| 5t | 9t-3t-1t | 15t | 27t-9t-3t | 25t | 27t-3t+1t | 35t | 27t+9t-1t |
| 6t | 9t-3t | 16t | 27t-9t-3t+1t | 26t | 27t-1t | 36t | 27t+9t |
| 7t | 9t-3t+1t | 17t | 27t-9t-1t | 27t | 27t | 37t | 27t+9t+1t |
| 8t | 9t-1t | 18t | 27t-9t | 28t | 27t+1t | 38t | 27t+9t+3t-1t |
| 9t | 9t | 19t | 27t-9+1t | 29t | 27t+3t-1t | 39t | 27t+9t+3t |
| 10t | 9t+1t | 20t | 27t-9t+3t-1t | 30t | 27t+3t | 40t | 27t+9t+3t+1t |

FIG. 11

TORQUE VENTING DURATION TABLE
JET REACTION CONTROL FIRING SEQUENCE FOR TWO NOZZLE CONFIGURATION
TO
GENERATE SPECIFIC TORQUE IMPULSE LEVELS

| FORCE LEVEL | FIRING SEQUENCE | FORCE LEVEL | FIRING SEQUENCE | FORCE LEVEL | FIRING SEQUENCE | FORCE LEVEL | FIRING SEQUENCE |
|---|---|---|---|---|---|---|---|
| 1t′′ | 1t′ | 11t′ | 9t′+3t′-1t′ | 21t′ | 27t′-9t′+3t′ | 31t′ | 27t′-3t′+1t′ |
| 2t′ | 3t′-1t′ | 12t′ | 9t′+3t′ | 22t′ | 27t′-9t′+3t′+1t′ | 32t′ | 27t′+9t′-3t′-1t′ |
| 3t′ | 3t′ | 13t′ | 9t′+3t′+1t′ | 23t′ | 27t′-3t′-1t′ | 33t′ | 27t′+9t′-3t′ |
| 4t′ | 3t′+1t′ | 14t′ | 27t′-9t′-3t′-1t′ | 24t′ | 27t′-3t′-1t′ | 34t′ | 27t′+9t′-3t′+1t′ |
| 5t′ | 9t′-3t′-1t′ | 15t′ | 27t′-9t′-3t′ | 25t′ | 27t′-3t′+1t′ | 35t′ | 27t′+9t′-1t′ |
| 6t′ | 9t′-3t′ | 16t′ | 27t′-9t′-3t′+1t′ | 26t′ | 27t′-1t′ | 36t′ | 27t′+9t′ |
| 7t′ | 9t′-3t′+1t′ | 17t′ | 27t′-9t′-1t′ | 27t′ | 27t′ | 37t′ | 27t′+9t′+1t′ |
| 8t′ | 9t′-1t′ | 18t′ | 27t′-9t′ | 28t′ | 27t′+1t′ | 38t′ | 27t′+9t′+3t′-1t′ |
| 9t′ | 9t′ | 19t′ | 27t′-9′+1t′ | 29t′ | 27t′+3t′-1t′ | 39t′ | 27t′+9t′+3t′ |
| 10t′ | 9t′+1t′ | 20t′ | 27t′-9t′+3t′-1t′ | 30t′ | 27t′+3t′ | 40t′ | 27t′+9t′+3t′+1t′ |

FIG. 12

PRECISION GUIDANCE SYSTEM FOR AIRCRAFT LAUNCHED BOMBS

RELATED APPLICATIONS

This application is a continuation-in-part of my application Ser. No. 08/853,607 filed Apr. 9, 1997, now U.S. Pat. No. 5,893,103. which, in turn, is a continuation-in-part of application Ser. No. 08/562,426 filed Nov. 24, 1995; now U.S. Pat. No. 5,657,947, in turn, a continuation-in-part of application Ser. No. 08/295,108 filed Aug. 24, 1994 now U.S. Pat. No. 5,507,452.

BACKGROUND OF THE INVENTION

This invention relates generally to the field of maneuverable vehicles, and more particularly to an improved and low-cost guidance system requiring a minimum number of components, as is desirable in the case of conventional bomb modification, to improve delivery accuracy. This system provides an extremely accurate and low-cost conventional bomb attachment kit that requires no modification to the delivery vehicle.

DISCUSSION OF THE PRIOR ART

A problem continually faced by personnel involved in the design, development, and operation of air-to-ground conventional weapons is how to precisely position those devices to neutralize the target within the constraints of cost, complexity, and aircraft survivability. Conventional weapons, such as unguided bombs, most often require the employment of considerable numbers in order to achieve the desired target results. This, in turn, most often requires large numbers of delivery aircraft using delivery geometry that places them in high risk situations.

Several methods of achieving micro-positioning have been considered. One method is through the use of fixed opposable force-based systems. Such a system will usually be comprised of a large number of thrusters fixed to the body of the maneuverable device. Combinations of these thrusters can then be fired to effect the desired maneuver. Two weapon systems that use this technique are the U.S. Army Hypervelocity missile and the Command Adjusted Trajectory projectile. There are several drawbacks to these fixed opposable force-based thruster-based systems. For most applications, a large number of thrusters are needed. More thrusters relates to a higher cost.

Another technique is the use of Global Positioning System (GPS). Current GPS navigation and guidance systems require three dimensional angular position data in order to navigate an air vehicle from one position to another. Current GPS navigation and guidance systems generally obtain attitude information from an inertial navigation system (INS). Such a system usually consists of three rate gyroscopes, three accelerometers, and associated processing equipment. INS types are very costly. Another experimental system employs GPS carrier phase measurement on multiple antennas (radio interferometry) to determine three-dimensional attitude. As disclosed in U.S. Pat. No. 5,101,356, these systems are also complex and may not have the necessary sensitivity and speed for guidance of smaller vehicles, such as conventional bombs.

SUMMARY OF THE INVENTION

Briefly stated, the present invention contemplates the provision of an improved navigation and maneuver system for conventional bombs, in which the above mentioned disadvantages have been substantially ameliorated.

Rather than the familiar GPS guidance and the on off thruster devices normally associated with thrusters, the present invention employs a unique and innovative "virtual umbilical" method to directly initialize the bomb GPS unit while still in the bomb/cargo bay, an inverse trajectory two point boundary guidance law to continually define best path guidance options using position and velocity states only, an innovative adaptive forward predictor polynomial network for guidance law implantation, and a compact jet reaction control system to effect bomb to target maneuver.

An RF (Radio Frequency) "virtual umbilical" weapon link uses an RF repeater to broadcast the GPS data obtained from the aircraft GPS system into the aircraft weapons bay to provide ephemeris and space vehicle clock data directly to the bomb for initialization. This method eliminates expensive changes to the aircraft by using the already installed GPS receiver system. It also provides for real-time bomb initialization while still in the weapons bay and significantly reduces the time in acquiring of the GPS satellite constellation.

An Adaptive Forward Predictor uses a polynomial network which permits the guidance law to be implemented with a multiplication concept rather than an integration concept. It also allows the trajectory to be wind compensated, permitting the guidance computer to be a low-cost 486-type or pentium processor chip. Moreover, the invention allows the bomb control forces to be obtained during flight using simple multiplication.

A jet Reaction Control Device makes use of a typical gas jet control system to effect bomb maneuver to the target. It permits the maneuver to be accomplished using an extremely low-cost approach. The compact jet reaction control concept permits the entire guidance kit to be packaged in an extremely small volume.

Applications of this new concept are both numerous and varied. it can be used wherever there is a need for very accurate positioning. This includes effecting maneuvers for guided missiles, artillery shells, and space vehicles. Potential applications include, but are not limited to, bombs, stand-off weapons, cruise missiles, unmanned surveillance vehicles, flying decoys to protect ships and aircraft, ground-launched munitions, antisubmarine weapons, atmospheric probes, and precision airdrop systems.

BRIEF DESCRIPTION OF THE DRAWINGS

In the drawings, to which reference will be made in the specification:

FIG. 11 illustrates a venting duration table for the generation of specific impulse levels.

FIG. 12 is a similar table used for generation of torque impulse levels.

DETAILED DESCRIPTION OF THE DISCLOSED EMBODIMENT

Overview

Figure 1:
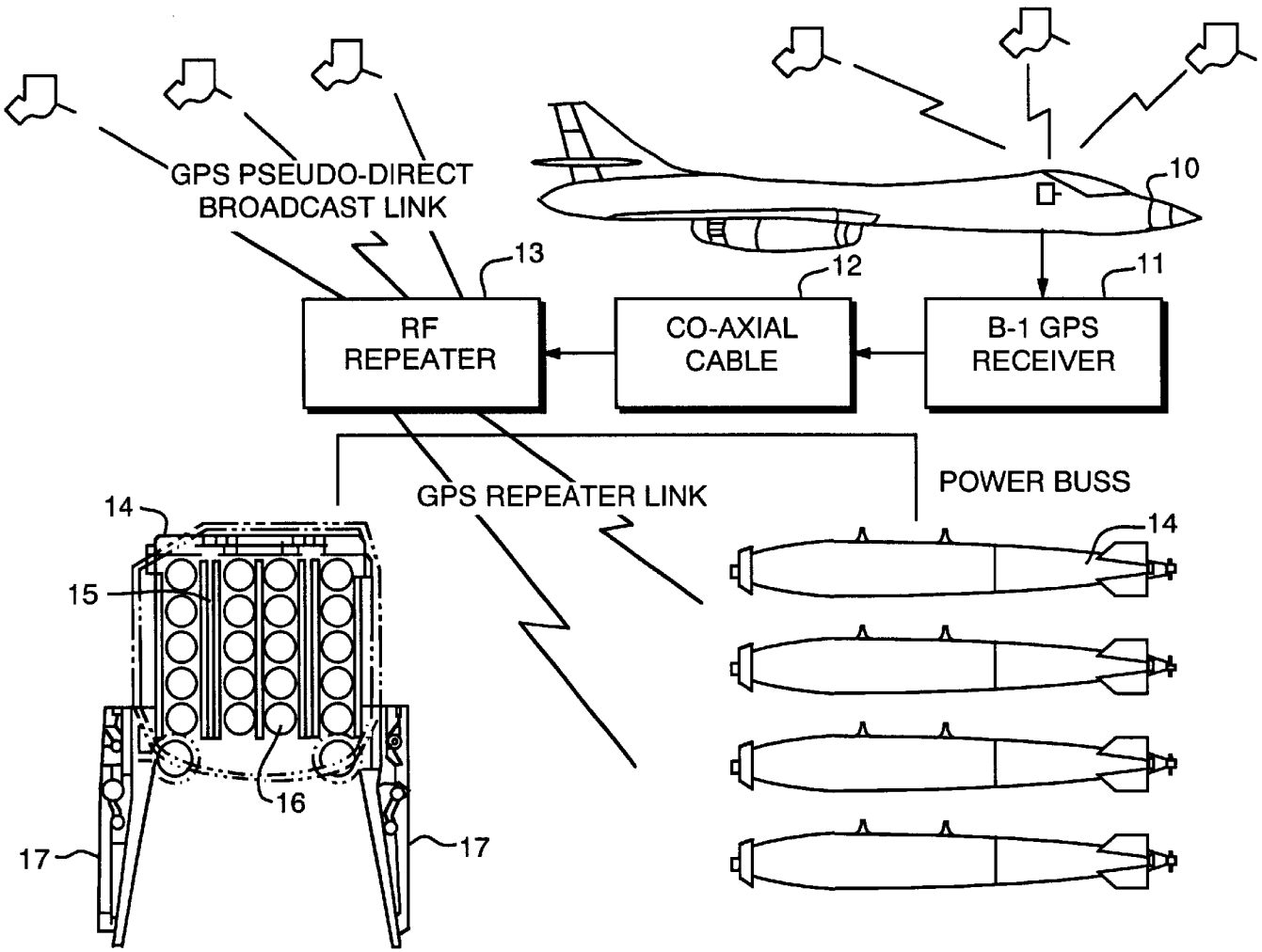
FIG. 1 is a pictorial concept view of the RF "Virtual Umbilical" weapon initialization forming a part of the disclosed embodiment.

The present invention makes use of current developments in GPS receivers and general signal processing technology. It also borrows ideas from systems in development, such as a jet control gas reaction to effect vehicle maneuvers. One component mounts into an existing fuse well thereby requiring no modifications to the bomb. A variety of guidance laws have been studied over the past several years including two point boundary value with multiple way points, minimum energy consumption trajectory, GPS-updated inertial, and discrete GPS-only guidance. The guidance law presented herein has been defined and demonstrated in computer simulations. The use of the two point value guidance law, employing inverse trajectories and using position and velocity states only, is an innovative means that continually selects the best path trajectory. Additionally, the use of an adaptive polynomial network or neural network permits a multi-tier curve fit to the inverse trajectory to be run off-line which enables the bomb to be guided with simple multiplication concepts. The RF "Virtual Umbilical" GPS link permits the maneuvering vehicle to be initialized while in a static state within the delivery vehicle. The use of an RF repeater to broadcast the GPS data obtained from the delivery vehicle GPS system into the delivery vehicle bomb/cargo bay to provide ephemeris and space vehicle clock data directly to the bomb (or other vehicle) to initialize its GPS system minimizes necessary modifications of both the aircraft and the bomb. A jet reaction maneuvering device is employed for maneuver control which is readily installed within the fuse well of existing ordinance.

System Operation

The disclosed Precision Guidance System consists of a GPS-guided vehicle (a conventional bomb) and an RF "virtual umbilical" GPS datalink. Each bomb in the aircraft receives station keeping power from a bomb on-board battery. Upon command from the aircraft, via an RF repeater link broadcasting into the bomb bay, the bomb initializes a thermal battery to provide autonomous power to a bomb guidance and control kit. Power is supplied to the bomb GPS receiver and the bomb GPS receiver is then brought into operation. The GPS receiver is initialized via an RF repeater link from the aircraft GPS receiver. The repeater broadcasts RF energy into the bomb bay to provide a "virtual umbilical" to each bomb to transmit satellite ephemeris and clock data. Upon bomb drop, the bomb thermal battery provides power to the bomb guidance unit. Transition power is provided by a capacitor bank on the bomb. Upon release from the aircraft, the bomb captures the coarse code transmissions from the satellites. Upon coarse code acquisition, the bomb transitions to P-code track. The acquisition of the P-code after launch requires approximately five seconds. The bomb receives velocity and position updates from the GPS satellites once per second, and uses these position and velocity updates to effect guidance to the target. The weapon employs a roll drift control scheme to effect guidance. The guidance law then estimates the probable impact point for the weapon and determines the control force necessary to move the bomb to hit the target. Pitch and yaw corrections are accomplished by firing the correct combination of up and down, and left and right jet nozzles so that the resultant force moves the weapon to the target. This control force is input continuously into the bomb during the entire descent. Upon target impact, the bomb tail fuse detonates the weapon. From a 40,000-foot drop, the bomb jet reaction control system has the capability to provide plus or minus 10,000 feet of up-range or down-range correction; and plus or minus 10,000 feet of cross-range correction.

The delivery envelope, defined as the maneuver capability of the jet reaction system, from a 40,000-foot drop is essentially a circle having a radius of approximately 10,000 feet. From 40,000 feet, each bomb would be dropped and then guided to within 20 feet or less of its intended target. The 10,000-foot delivery envelope is large enough to allow the bombs to be dropped with each bomb being programmed to engage up to five different targets or more from its release point. Each bomb can be set during the mission planning stage to maneuver either to the target closest to its unguided impact point or to a given target located in the drop zone within the bomb footprint. The maneuver envelope is sufficiently large so that the weapon cannot miss.

RF "Virtual Umbilical" System

A radio frequency (RF) repeater is used to broadcast into the bomb bay the GPS signal necessary to initialize the GPS weapons in the bomb bay/cargo compartment. The RF repeater is also used to initialize the guidance kit thermal battery in all weapons. This is accomplished by transmitting a beginning message code to all bombs before the GPS data is provided to the weapons via the RF repeater link. This transmission of the GPS data, with the power-up command is accomplished by linking the aircraft GPS receiver to the RF repeater by a coaxial cable. Appropriate ephemeris and clock data from the aircraft GPS receiver is broadcast into the bomb bay/cargo compartment where it is used by each bomb to initialize their GPS receivers to track the P-code signal. Upon bomb release, the phase locked loops in the bomb GPS receivers would be anticipated to drift sufficiently to make it impossible to immediately reacquire the P-code signal. Consequently, the initiation process upon release first captures the C-code or course signal and then transitions to the track of the P-code signal. This is anticipated to require approximately five seconds. The use of the RF repeater as a means of initializing the GPS receivers on the bomb eliminates the requirement for any major modification of the delivery aircraft. Most aircraft have an open conduit which would allow the running of the coaxial cable necessary to the repeater. It is necessary only to interface that repeater to the aircraft GPS receiver.

Inverse Guidance

The bomb in the disclosed embodiment utilizes a two point boundary value guidance law to effect guidance of the current bomb position, i.e., the first point, to the target position, i.e., the second point. To allow this to be accomplished using only GPS position and velocity, the two point boundary value law is implemented "backwards". This is accomplished by integrating trajectories from the target coordinates backward into space to define all of the possible trajectories which have an end point at the target. At any plane traversing these trajectories, the intersection point of all of the trajectories which impact the target can be determined and the velocity and position states at these points established. The bomb passing through this plane would need only to know what its state is and the nearest state to the best path trajectory which would intercept the target. With this knowledge, the weapon can then effect a course correction to move to the best path trajectory and, ultimately, hit the target. Implementation of this two point boundary value guidance law is accomplished by integrating, off-line, all of the trajectories backwards and at every one-second interval, for example, stowing the data in terms of velocity and position in a micro-processor where they are then used by the guidance law in a look-up table to determine what the appropriate control force is to move the bomb to the nearest best path trajectory.

However, rather than use a look-up table, an adaptive polynomial network or neural network is employed which essentially "curve fits" the data calculated from the inverse integration of all the necessary trajectories. This adaptive polynomial network or neural network uses position and velocity and an approximate time to go in a multi-tier curve fit.

The use of the simple inverse trajectory two point boundary value guidance law allows the bomb to be flown knowing only bomb position and velocity. The position and velocity is provided by the GPS receiver in the guidance system. The target position is provided to the bomb prior to upload in GPS coordinates. The bomb roll angle in body coordinates is measured by a roll gyro or a magnetic sensor which measures the earth's magnetic field and establishes a reference control plane. The target position, GPS bomb position, and bomb orientation in the inverse trajectory implementation allows a simple type 386 processor to determine the divert commands and body coordinates to cause the bomb to intercept the target by moving to the best path nearest trajectory. It should be noted that as the weapon continues its flight that it is constantly correcting to the best path trajectory to intercept the target and never attempts to return to an original trajectory. This process conserves maneuver energy since the weapon is continually flying the best path to the target.

Forward Predictor

An adaptive polynomial network or neural network can be employed which essentially "curve fits" the data calculated from the inverse integration of all the necessary trajectories. This adaptive polynomial network or neural network uses position and velocity, and an approximate time to go in a multi-tier curve fit concept. In each tier, polynomials are utilized to convert the position, velocity, and time to go, to a prediction which is used by subsequent tiers which ultimately lead to the determination of the necessary force to move the bomb to the nearest best path trajectory which will intercept the target The inverse guidance concept allows the bomb guidance to be effected using only adaptive polynomial network or neural network curve fit to the trajectory data run off-line to determine control commands. This is only a multiplication process with the coefficients for the polynomials in each predictive tier stored in memory. Consequently, the guidance calculations are accomplished by a very low-cost computer such as an Intel 386-based machine.

The closed form solution for the bomb trajectory is determined for a vacuum trajectory for the bomb utilizing the initial GPS-provided velocity and position data. The difference between this vacuum trajectory and the actual bomb trajectory is due to differential ballistic force consisting of ballistic density effects and aeroballistic wind and control forces. The control force is known. Ballistic density can be estimated by calculating the drag on the weapon by comparing weapon current velocity in initial vacuum velocity and the estimated velocity in the trajectory states. Ballistic wind forces can also be estimated by comparing the bomb position in the trajectory to the vacuum trajectory position, corrected for drag. This difference is curve fitted with a second adaptive polynomial network or neural network which takes the current weapon states and provides an estimate to differential ballistic force based on the closed form trajectory solution. This output is then input into the adaptive polynomial network or neural network which calculates the control force and direction necessary to move the bomb on the best path intercept trajectory. This calculation is compensated for ballistic wind.

Jet Reaction System

The disclosed jet reaction system employs a device including a solid gas generator, a jet control valve assembly, an electromagnetic cover, and an electronics module. The control valve assembly consists of fast-acting solenoid actuators, poppet valves, and a hollow valve plate. The valve plate incorporates four sets of left and right nozzles. Upon launch, the solid gas generator is pressurizing the system to 1,000 pounds pressure. The flow through each of a plurality of left and right firing nozzles is controlled through poppet valves which, in turn, are controlled by a fast-acting solenoid actuator receiving commands from an autopilot. The poppet valves provide continuous correction to the bomb attitude and trajectory during fall. The valve opening cycle is of the order of 20 to 200 milliseconds. The thrust of the control system varies typically from zero pounds to a maximum of 40 pounds and the burn time for the propellant is approximately 60 seconds. This variable control—variable force jet reaction system allows for the precise control of yaw, pitch and roll.

DETAILED DESCRIPTION OF THE DISCLOSED EMBODIMENT

With the foregoing discussion in mind, reference may now be made to the drawings. FIG. 1 illustrates a conventional military aircraft 10, typically a B-1 bomber, equipped with a GPS receiver 11 connected by coaxial cable 12 to a RF repeater 13. The aircraft bomb bay 14 is substantially unaltered, and includes storage racks 15 accommodating plural converted bombs 16, typically a known Mark 82 Lancer currently employed by the U.S. Armed Forces. The bomb bay doors 17 are opened and closed in conventional manner.

Figure 9:
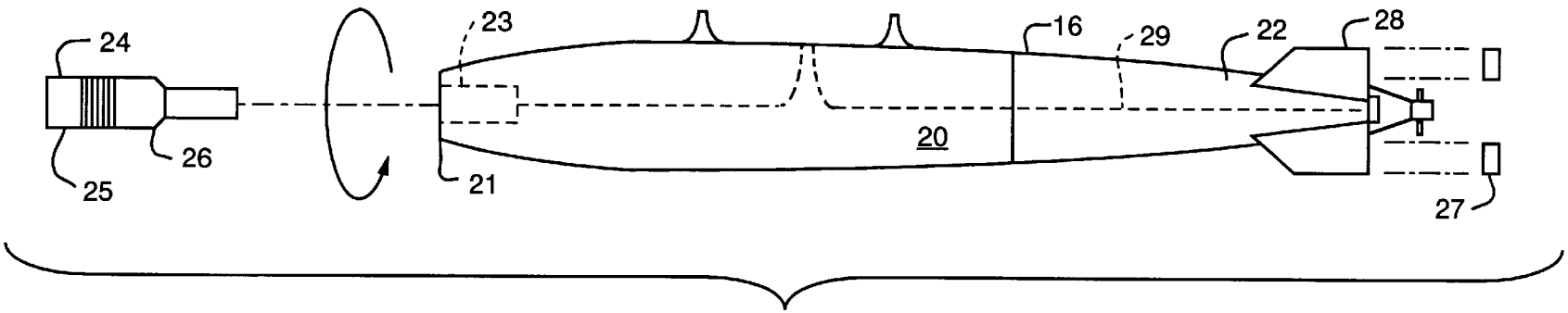
FIG. 9 is an exploded view in perspective showing a conventional aircraft launched bomb fitted with a guidance kit forming a part of the disclosed embodiment.

As best seen in FIG. 9, each bomb 16 includes a main body or casing 20 extending from a head or leading end 21 to a tail section 22. The head end includes a fuse well 23 which accommodates a conventional time or impact fuse which is replaced by the present system. The bomb would be tail fused when guided by the present system. Positioned in the well 23 is a guidance unit 24 having a corresponding well-engaging projection and including a guidance electronic section 25 and a GPS P-code receiver 26. A tail antenna 27 is positioned on or near tail fins 28, and leads 29 interconnect the antenna with the unit 24. As illustrated in FIG. 1, the RF repeater 13 upon the initiation of operation broadcasts directly to the bomb bay 14 initial GPS data and the necessary initiation signal prior to discharge of an individual bomb.

Figure 2:
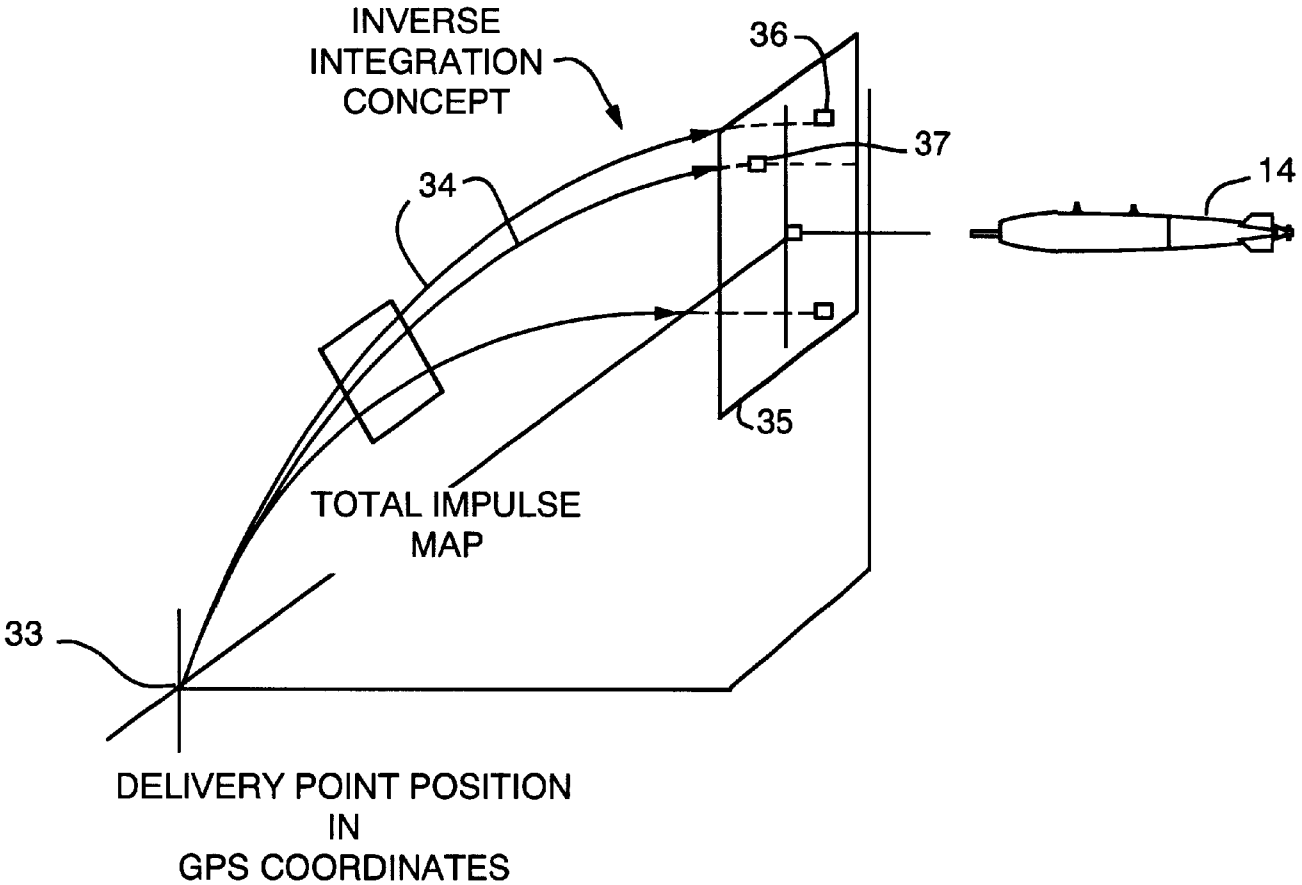
FIG. 2 is a schematic representation of an inverse guidance concept.

Referring to FIG. 2, there is graphically illustrated the inverse guidance concept discussed above. Reference character 33 designates the delivery point representing the second end of plural trajectories 34 which are intersected by a plane 35 to define multiple points 36 on each trajectory, including a point 37 which is closest to a particular bomb 14. At the time of discharge, the bomb possesses data relative to GPS velocity, position, and time to go.

Figure 2A:
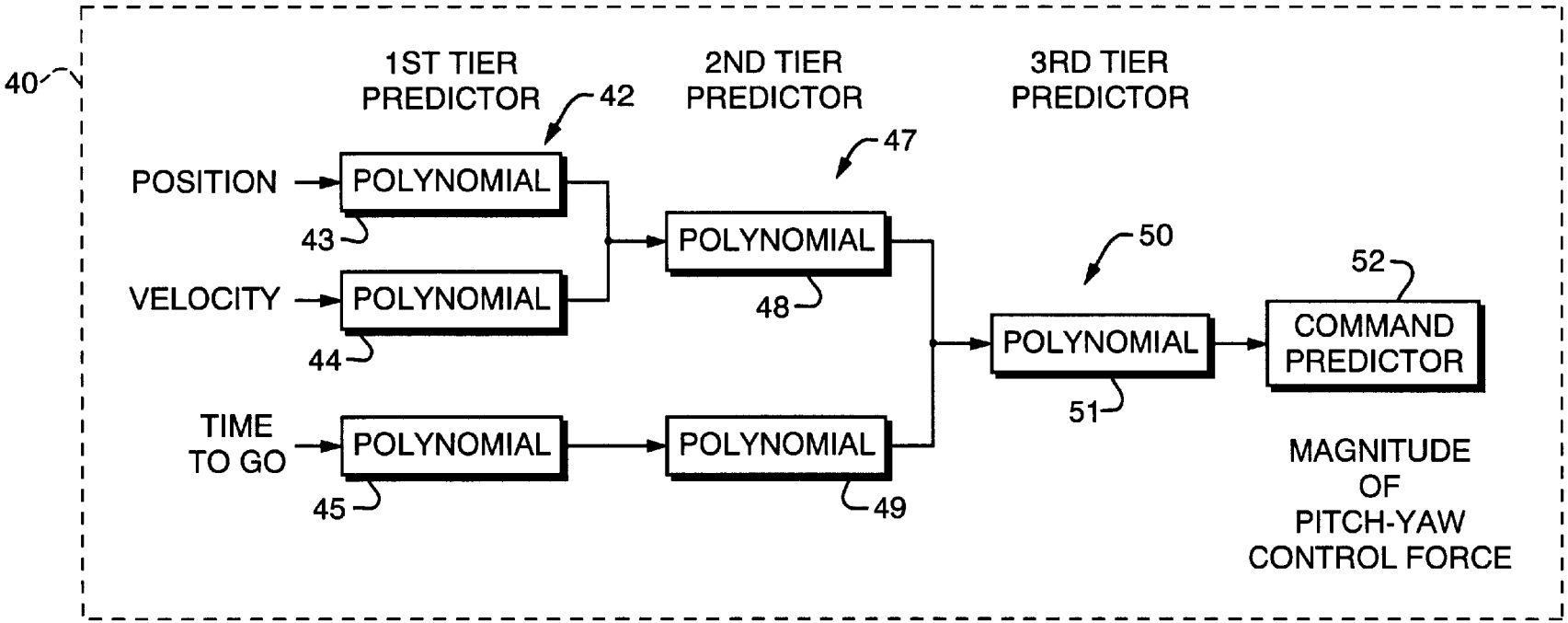
FIG. 2*a* is a block diagram of a polynomial network.

FIG. 2*a* graphically illustrates a first adaptive polynomial network or neural network 40 including a first tier predictor 42 including polynomials 43, 44, and 45, relating to position, velocity, and time to go. The output of these polynomials is fed to a second tier predictor 47 including first and second polynomials 48 and 49. The output of the second tier is fed to a third tier predictor 50 including a single polynomial 51 feeding a command predictor 52 which determines the magnitude of a pitch-yaw control force required in order to move the bomb onto the nearest trajectory.

Figure 3:
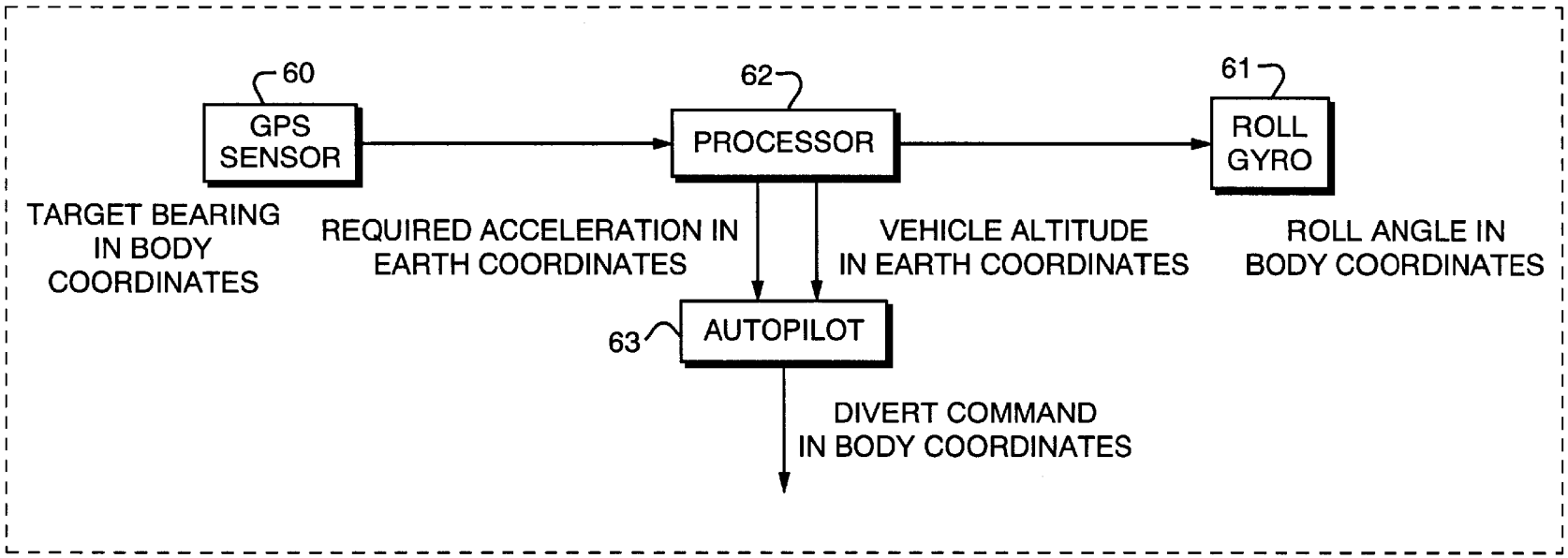
FIG. 3 is a block diagram showing input/output flow of the two point boundary inverse trajectory guidance law.

FIG. 3 graphically illustrates the use of a two point boundary value guidance law, wherein a GPS sensor 60 provides a target bearing in terms of body coordinates which data is fed to a processor 62. The processor also receives roll angle data in terms of body coordinates from a roll gyro 61. The processor 62 supplies divert commands to an auto pilot 63 in terms of body coordinates.

Figure 4:
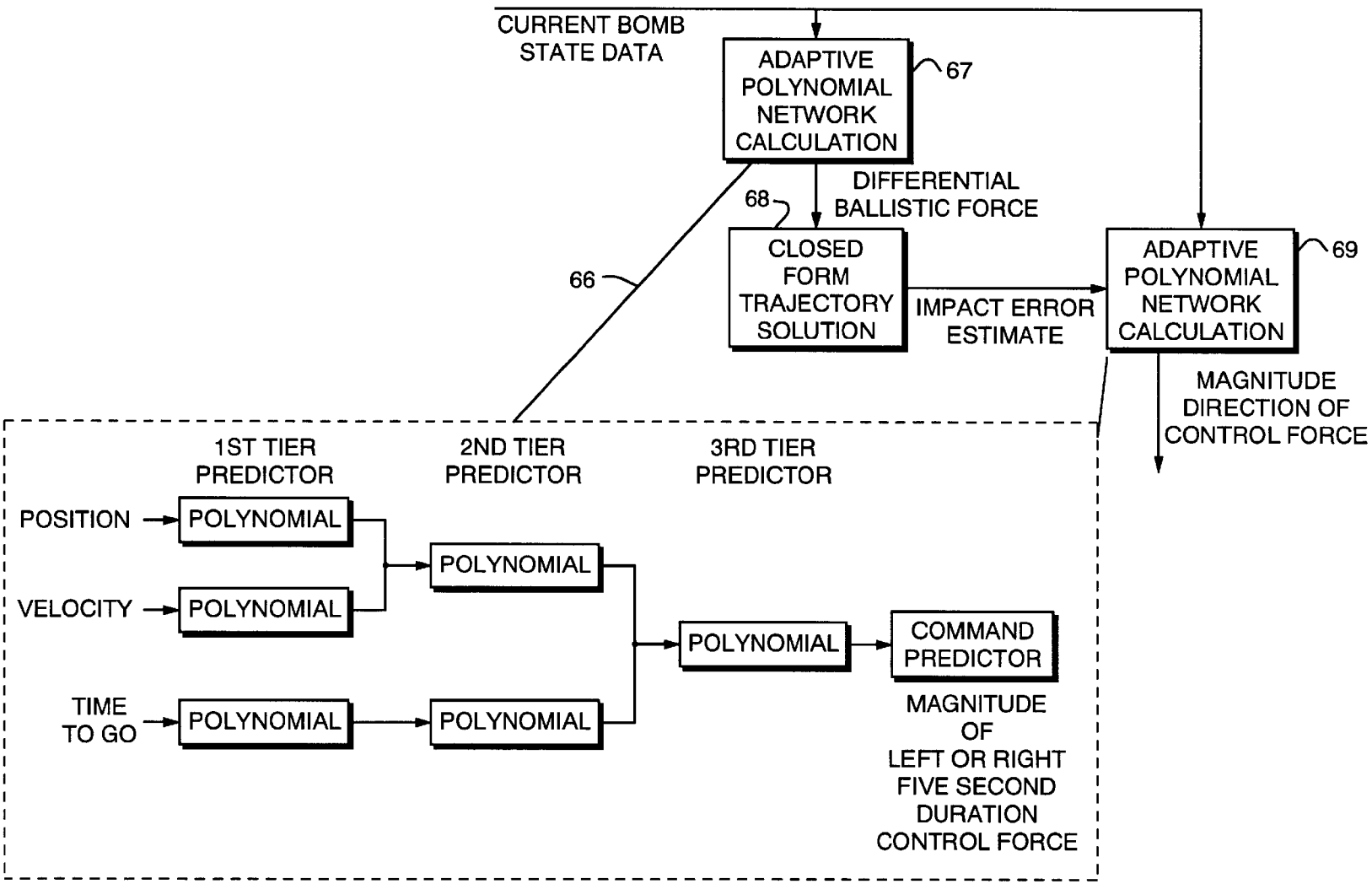
FIG. 4 is a block diagram of a forward predictor adaptive polynomial network or neural network.

FIG. 4 graphically illustrates the operation of the adaptive polynomial network or neural network of FIG. 2*a,* wherein current bomb state data 66 is subjected to the adaptive polynomial network or neural network calculation at 67, the output of which is fed to a closed form trajectory solution 68 which provides an impact error estimate as part of a second adaptive polynomial network or neural network calculation 69.

Figure 5A:
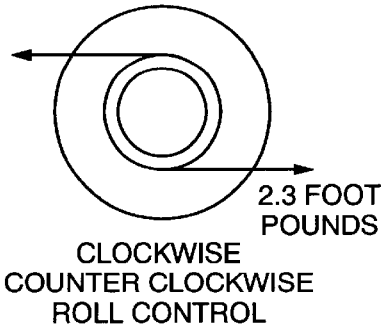
FIGS. 5*a* through 5*f* is a concept diagram showing a jet reaction control maneuver system depicting various control functions forming part of the embodiment.
Figure 5B:
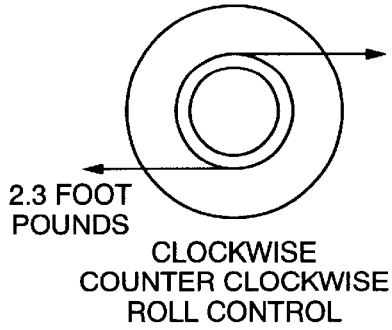
Figure 5C:
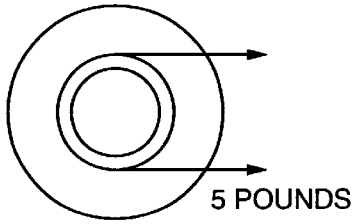
Figure 5D:
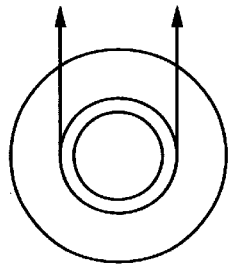
Figure 5E:
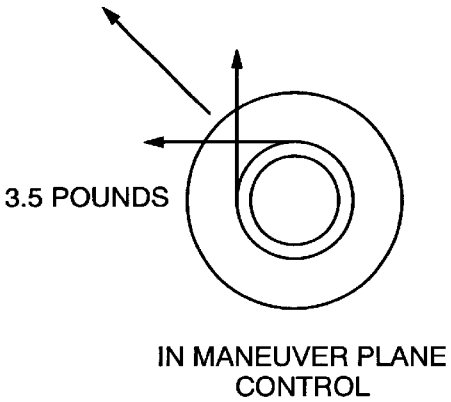
Figure 5F:
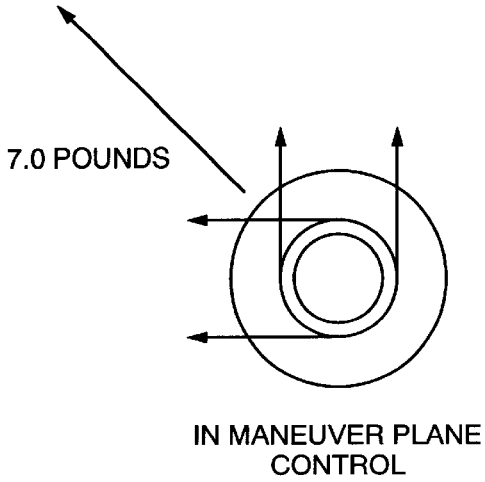

FIGS. 5*a* through 5*f* illustrate the various available forms of thrust used to steer the bomb to the nearest best trajectory. FIGS. 5*a* and *b* illustrate clockwise and counter clockwise roll control. FIGS. 5*c* and 5*d* illustrate left/right control and up/down control, respectively. FIG. 5*e* illustrates the use of thrust from two nozzles at a mutual 90 degree angle to obtain a resultant thrust at a 45 degree angle. FIG. 5*f* shows the use of four jet nozzles with greater effective thrust to obtain a similar result.

Figure 6:
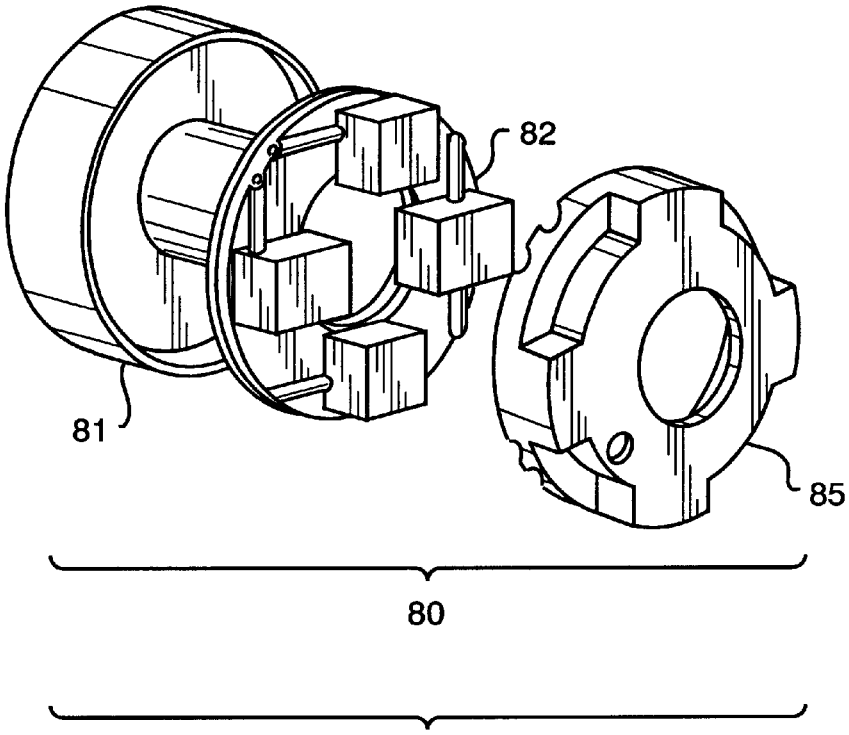
FIG. 6 is an exploded view in perspective of a jet reaction device adapted to be fitted to the front end of a bomb.
Figure 7:
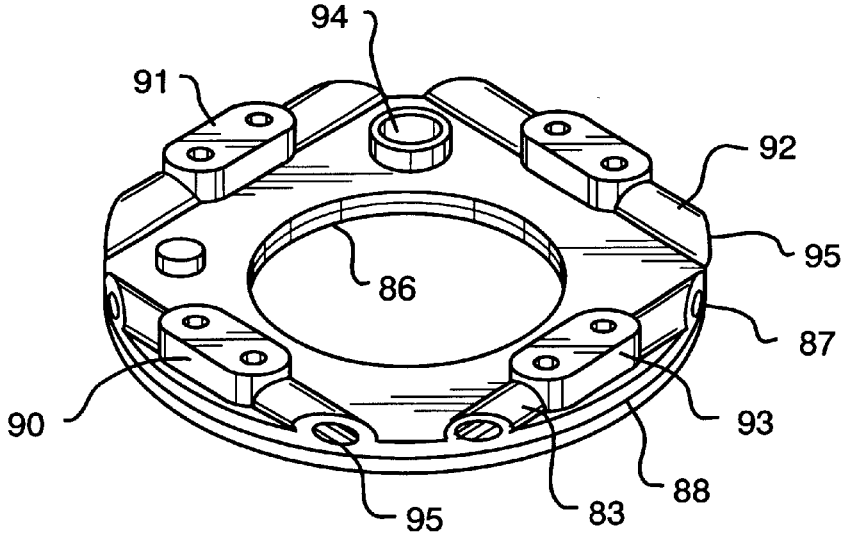
FIG. 7 is a view in perspective showing a valve plate element comprising a part of the jet reaction device.
Figure 8:
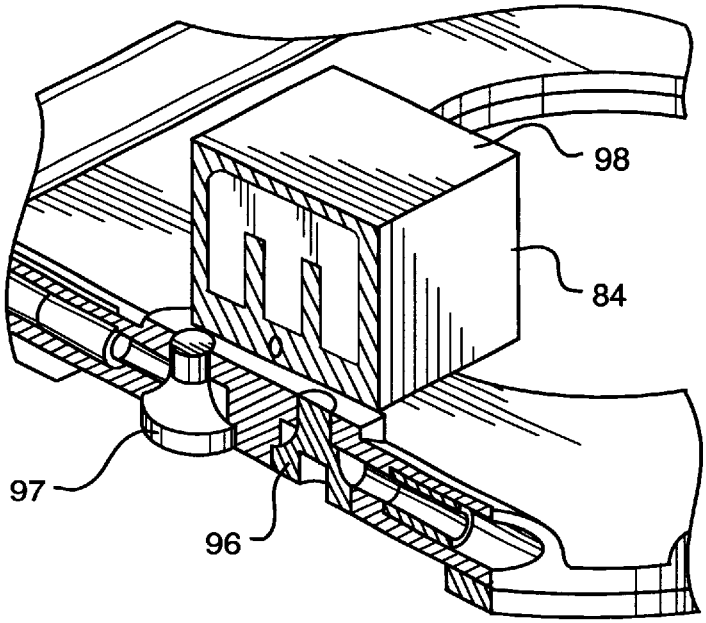
FIG. 8 is a fragmentary view in perspective showing a valve control element in position upon the valve plate element shown in FIG. 6.

FIGS. 6, 7, and 8 illustrate a jet reaction device 80 including a solid propellant gas generator 81, a control valve assembly 82 including a valve plate 83 (FIG. 7) controlled by a multiple solenoid actuator 84 enclosed within an electromagnetic cover 85. The device 80 includes a through bore 86 which enables it to be fitted at the free end of the fuse well 23 (see FIG. 9). As best seen in FIG. 7, the plate 83 includes first and second parallel walls 87 and 88 defining an internal passage or interstice (FIG. 8) which feeds four jet nozzle assemblies 90, 91, 92 and 93 located at the circular periphery of the plate 83 at 90 degree intervals. An intake port 94 communicates with the gas generator 81 to receive gas which is distributed to each of jet nozzle assemblies. Each jet nozzle assembly includes a pair of oppositely facing jet nozzles 95 which are controlled by a dual valve seat member 96 (FIG. 8) opened by pairs of poppet valves 97 independently controlled by a solenoid actuator unit 98 which receives control commands from the guidance electronics.

Referring again to FIG. 9, while the GPS antenna system 27 is mounted at the tail section 22 of the bomb, the remaining components are all positioned at the forward end 21 of the main body 20, and installation is a simple "plug-in" operation which may be done at any time prior to the loading of the bomb bay, and after the electronics have been programmed for a preselected target or targets. In some instances, it may be desirable to reconfigure the housing of the guidance unit in order that the overall length of the bomb remain unaltered, thus facilitating the fitting of the bomb within the bomb bay.

The jet reaction device 80 illustrated in FIGS. 5, 6, and 7, lends itself to substantial variations, depending upon the airframe, and the type of control required.

The thrust from any nozzle can be calculated as:

$$T=WV/g_c$$

where:

W=Mass flow through the nozzle in pounds per second

V=Exit velocity from the nozzle.

$g=32.2\ lb_m ft/lb_f sec^2$

Here 1 bm denotes pounds of mass and 1 bc denotes pounds of force. The calculation assumes the entrance velocity to the nozzle is shall relative to the exit velocity and that the pressure ration across any of the eight nozzles is such to insure that the nozzle operates in a choked mode such that the mass flow rate through the nozzle is fixed to a design value. The total impulse from a nozzle is controlled by controlling the time which the poppet valve is left open to allow the hot gas from the hot gas generator to vent from the nozzle. The total impulse, in turn, determines the control force being imparted to the air vehicle. It should be noted that there are two options in the bi-directional concept including generating:

a. Maneuver Force. To effect maneuver all poppet valves would be closed with the exception of the two adjacent nozzles which control the resultant force passing through the centerline of the missile as shown in FIGS. 5*c*–5*f*. In the case of an endoatmospheric vehicle, the jet reaction control would act to generate a control force which would place the air vehicle at an angle of attack to generate aerodynamic lift with canards, wings and tail surfaces individually or in combination. In the case of an exoatmospheric vehicle, the jet reaction control system would act to generate maneuver force direction due to the total impulse generated by the jet reaction control system.

b. Roll Control or Spin Torque. To effect roll control or to spin up the air vehicle about its centerline, the appropriate poppet valves would be closed to cause the remaining nozzles to vent in such a way to induce torque into the air vehicle as shown in FIGS. 5*a*–5*b*. Either right hand or left hand torque can be generated.

When no control force is required, the control system would cycle all poppet valves at a high cyclic rate, of the order of 20 to 200 milliseconds, to equally vent all nozzles such that the resultant force and torque on the air vehicle is zero. This precludes the high pressure gas generator from experiencing a structural failure due to over pressure.

Figure 10:
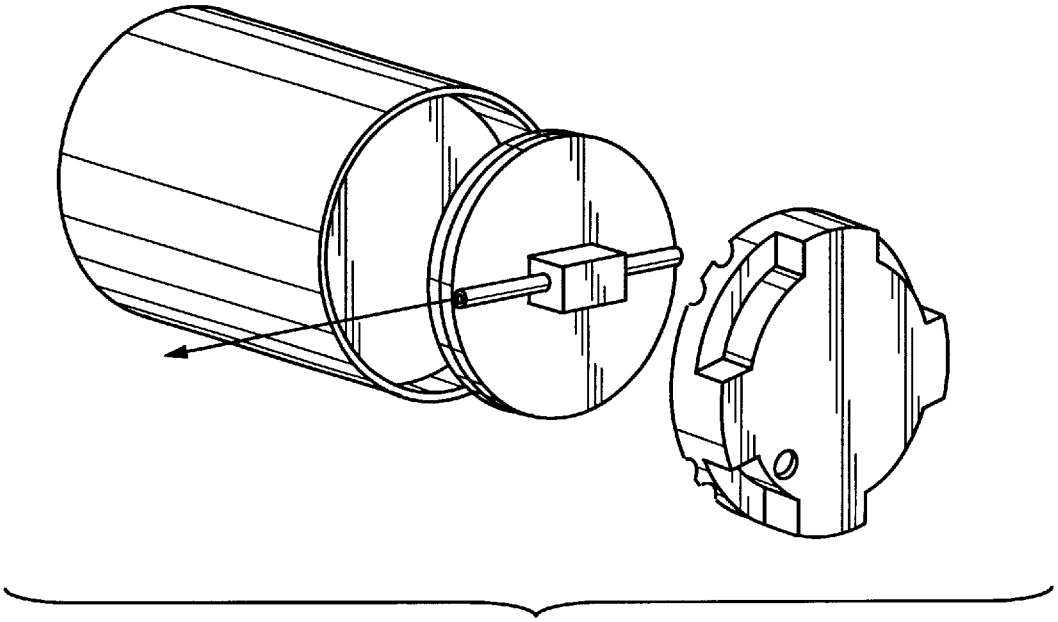
FIG. 10 is an exploded view in perspective of a jet reaction device similar to that seen in FIG. 6, but showing a single multi-directional nozzle.

A bi-directional jet reaction control concept offers the potential to provide the low-cost control concept. The simplest form of the more general bi-directional nozzle concept, as discussed previously, would apply to it to a forced flow airframe control scheme. it would employ a single bi-directional nozzle controlled by a single solenoid operating on two poppet valves. In the simplest concept, as the air vehicle rolls about its axis, the control of the poppet valves would be implemented such that flow from the nozzle would be applied either left or right in the control plane, depending on the direction the bomb or air vehicle was to move, as the nozzles rotate around and come in line in the control plane in that direction. (FIG. 10). Because of the high pressure in the gas generator, both nozzles would be vented at a high cyclic rate, typically on the order of 100 to 200 milliseconds, such that the net control force during rotation of the missile would be zero since the nozzles are venting in opposite directions at the same rate. When control force is required, that poppet valve which controls the nozzle which is coming into the line in the control plane is left open and the other nozzle is held closed resulting the control force being generated. The time the poppet valve is left open determines the impulse generated by that nozzle as it moves through the control plane. Because, in a bi-directional nozzle concept, a nozzle passes through the control plane in such a way as to allow control force to be generated in a preferred direction twice each revolution, the bi-directional nozzle offers the ability to input control forces into the control plane every half cycle compared to every cycle for a single-nozzle system.

The impulse required to move the airframe to a desired angle of attack can be calculated beforehand so that the time the nozzle is allowed to vent as it passes through the control plane can be predetermined. The actual angle of attack can be determined, in a closed loop control logic, by a rate gyro to insure the desired angle of attack is achieved or, in certain control laws such as the Inverse Guidance Law, discussed above, can be achieved within certain limits without feed back. An alternate approach is one in which both nozzles are left to vent with the vent time of one less than the vent time of the other which would result in a net force being applied in the control plane. This approach allows the bi-directional nozzle to be used in a manner described in my prior U.S. Pat. No. 5,456,429 to simplify the bi-directional nozzle concept even further. Since the bi-directional nozzle can fire in either direction as it passes through the control plane, a base Mn thruster concept can be used to set the duration in which the poppet valves are left open. The impulse generated by one of the two nozzles in the bi-directional using the Base 3 example taught by this patent can be Ft, 3 Ft, 9 Ft, 27 Ft, which, when combined with a bi-directional nozzle, allows impulse levels from Ft to 40 Ft in steps of Ft to be realized. This is the case where the Base 3 number system employs impulse values up to the third power.

FIG. 11 details the force table for a single bi-directional nozzle being employed in a forced roll airframe control using a Base 3 approach to control the time duration which the two nozzles in the bi-directional nozzle are vented to control the total impulse generated. In implementation, the computer would determine the time values to be employed in the left firing and right firing nozzles in the control plane to generate the appropriate total impulse in a simple table look-up on time which, in turn, would be used to provide clocking for the time which the poppet valves on each nozzle are left open. It is to be noted that the force flow control using a bi-directional nozzle positioned on the centerline of the missile allows the control force to pass through the centerline of the missile which, in turn, avoids inputting torque into the missile to change the roll rate.

A roll drift or a roll-controlled airframe requires control force in both the pitch and yaw direction since the air vehicle can not be, in general, anticipated to be rolling. In addition, in the case of the roll-controlled airframe, the control system should be capable of generating roll torque about the missile centerline to control the missile or bomb roll rate. (FIGS. 5*a*–5*b*). In this case as previously described, the valve plate would contain four bi-directional nozzles located about the periphery of the valve plate assembly. This approach enables adjacent nozzles and two bi-directional nozzle assemblies to be vented together to generate equal impulse such that the impulse vector, which is the resultant of the two nozzles, passes through the centerline of the missile or bomb allowing force and, in turn, impulse, to be put in the control plane along a resultant vector. The concept also offers the ability, by firing every other nozzle in a bi-directional nozzle system about the periphery in the same direction, to generate roll torque to either spin the missile or bomb up to a predetermined roll rate or to prevent the missile, in terms of a roll control scheme, from rolling at all.

In the simplest case, a single set of paired nozzles can be employed to generate either a pitch control force or impulse, up or down, or a yaw control force, left or right. As previously explained, the four bi-directional nozzle system may be used to effect control in a force roll, roll drift, or roll-controlled airframe control system. The bi-directional nozzle system, however, allows force to be generated in two directions in the pitch plane and in two directions in the yaw plane at the same time. Consequently, by employing the Base 3 concept, as taught by the above-mentioned patent, as an example, to control the duration of the venting of a nozzle, the bi-directional system can be used to generate impulse levels in the pitch plane from F to 40 F, in steps of F by firing the four nozzles in the pitch plane in pairs such that the result generates the correct impulse. This can be implemented using a simple table look-up to determine the duration of venting from any particular pair of bi-directional nozzle pairs. (FIG. 11). This approach simplifies considerably the control of a four nozzle bi-directional nozzle control system. It should be noted that the same system can be employed in controlling roll torque in a roll-controlled or force flow-controlled missile design with the exception that the control forces generated differ by the cosine of 45 degrees which need to be included in the calculation of impulse in the determination of roll. This again assumes that the example uses only the time to the third power as the means of controlling the torque. In the same sense, the impulse generated in torque pairs may be used to generate torque from Ft to 40 Ft in steps of Ft.

It should be noted that the example which uses the bi-directional nozzles in a base Mn approach is a special case of a more general implementation which would determine the duration in which appropriate poppet valves remain open to generate the appropriate torque or impulse exactly through use of a computer. This would allow the bi-directional nozzle to be open for a predetermined time to generate the necessary impulse. The use of the Mn concept simplifies this more general implementation of the jet reaction control system.

FIG. 12 illustrates a torque venting duration table where the nozzles are used to impart torque, rather than translational impulses.

It may thus be seen that I have invented a novel and highly useful precision guidance system for conventional aircraft launched bombs (or other vehicles) which is considerably simpler in construction and operation than that of the prior art, and particularly suited for use with any vehicle which needs an inexpensive method of effecting precision position. The system provides significant control force and accuracy while requiring only limited space. The cost to manufacture such a system, because of its simplicity, will be substantially less than that of prior art systems, while affording considerably more accurate results, decreased expendable expenditures, and decrease the delivery vehicle sortie rate.

I wish it to be understood that I do not consider the invention to be limited to the precise details of structure shown and set forth in the specification, for obvious modifications will occur to those skilled in the art to which the invention pertains.

I claim:

1. A jet reaction system for guidance of a free fall vehicle comprising a housing, means for mounting said housing externally of said vehicle in coaxial relation therewith, a gas generator element, a valve plate element communicating with said gas generator element, and having a peripheral area, said gas generator element and valve plate element being positioned within said housing; said means mounting said housing including means for engaging an end of said vehicle; said valve plate element having nozzles at substantially equally spaced locations around said peripheral area, each of said locations having a pair of nozzles arranged 180 degrees apart, each of said locations having a valve controlling each nozzle, and an actuating means for controlling each valve; whereby upon actuation of selected valves, thrusts may be obtained either singly or in combination in any required transverse direction.

2. A device in accordance with claim 1 in which said valve plate element comprises a pair of parallel walls defining a passage therebetween, one of said walls communicating with said gas generator element, said nozzles communicating with said passage.

3. A device in accordance with claim 1, said housing enclosing guidance electronics and a GPS P-code receiver electronics, said housing having a through axial bore, said vehicle having a cylindrical extension, said bore being engaged upon said cylindrical extension.

4. A system in accordance with claim 1, in which said nozzles are controlled by solenoid actuated poppet-type valves.

5. A device in accordance with claim 1, said housing having a cylindrical outer surface, said vehicle having a cylindrical recess at a forward end thereof, said housing engaging said recess.

* * * * *